United States Patent [19]

Coleman

[11] 4,233,544

[45] Nov. 11, 1980

[54] INPUT-KEEP ALIVE ARRANGEMENT FOR PLASMA CHARGE TRANSFER DEVICE

[75] Inventor: William E. Coleman, Colorado Springs, Colo.

[73] Assignee: NCR Corporation, Dayton, Ohio

[21] Appl. No.: 37,586

[22] Filed: May 9, 1979

[51] Int. Cl.[3] ..... H05B 41/30

[52] U.S. Cl. ..... 315/169.2; 313/188; 340/768; 340/805

[58] Field of Search ..... 315/169.2, 169.4; 313/188, 220; 340/758, 768, 776, 805

[56] References Cited

U.S. PATENT DOCUMENTS

| | | | |
|---|---|---|---|
| 3,775,764 | 11/1973 | Gaur | 340/768 |
| 3,781,600 | 12/1973 | Coleman et al. | 340/805 X |
| 4,051,409 | 9/1977 | Craycraft | 315/169.2 |

*Primary Examiner*—Eugene R. LaRoche
*Attorney, Agent, or Firm*—J. T. Cavender; Philip A. Dalton

[57] ABSTRACT

A pair of electrodes perform both input and keep-alive functions in a plasma charge transfer device. The input-keep alive electrodes are formed on opposite walls of the device adjacent an array of transfer electrodes and are capacitively coupled to the ionization gas. (1) Repetitive and (2) selective voltage pulses are multiplexed to the input-keep alive electrodes and snychronized with transfer electrode pulsing, to provide (1) a keep-alive function and (2) the selective input of data to the charge transfer device. The erase electrodes may also be capacitively coupled to the gas. A pulsing technique is described for restoring charge neutrality to the input-keep alive electrodes and erase electrodes after each input or erase function.

9 Claims, 25 Drawing Figures

ERASE
MODE TWO t =
1
2
3
3'
3"
4
5
6
7
7'
7"
8
9
$I_0$
$V_S$
0
KEEP
ALIVE
$V_i$
I
10 μs
1
20 μs
2
3
4
10 μs
10 μs
$E_0$
20 μs
5 μs
$V_e$
5 μs
E

FIG. 8A

LOAD
MODE ONE

| ELECTRODE | $I_0$ | I | 1 | | | | 2 | | | | 3 | | | |
|---|---|---|---|---|---|---|---|---|---|---|---|---|---|---|
| GROUP NO., g = | | | 1 | 2 | 3 | 4 | 1 | 2 | 3 | 4 | 1 | 2 | 3 | 4 |
| TIME 0 | $V_S$ -- | ++ 0 | $V_S$ | $V_S$ | $V_S$ | 0 | $V_S$ | $V_S$ | $V_S$ | 0 | $V_S$ | $V_S$ | $V_S$ | 0 |
| 1 (LOAD "1") | $V_S$ - | --- $V_I$ | 0 +++ | $V_S$ | $V_S$ | $V_S$ | 0 | $V_S$ | $V_S$ | $V_S$ | 0 | $V_S$ | $V_S$ | $V_S$ |
| 1' | $V_S$ -- | ++ 0 | 0 ++ | $V_S$ | $V_S$ | $V_S$ | 0 | $V_S$ | $V_S$ | $V_S$ | 0 | $V_S$ | $V_S$ | $V_S$ |
| 2 | $V_S$ -- | + 0 | $V_S$ -- | ++ 0 | $V_S$ | $V_S$ | $V_S$ | 0 | $V_S$ | $V_S$ | $V_S$ | 0 | $V_S$ | $V_S$ |

FIG. 9A

HOLD

| ELECTRODE | GROUP NO., g = 1 | | | | 2 | | | | 3 | | | | E | $E_0$ |
|---|---|---|---|---|---|---|---|---|---|---|---|---|---|---|
| TIME | 1 | 2 | 3 | 4 | 1 | 2 | 3 | 4 | 1 | 2 | 3 | 4 | | |
| 1 | 0 | $V_S$ | $V_S$ | $V_S$ | 0 | - | $V_S$ − | $V_S$ − | 0 ++ | $V_S$ | $V_S$ | $V_S$ | 0 | 0 |
| 2 | $V_S$ | $V_S$ | $V_S$ | $V_S$ | $V_S$ | $V_S$ | $V_S$ − | $V_S$ ++ | $V_S$ − − | $V_S$ | $V_S$ | $V_S$ | 0 | 0 |
| 3 | $V_S$ | $V_S$ | 0 | 0 | $V_S$ | $V_S$ | 0 ++ | $V_S$ − − | $V_S$ − | $V_S$ | 0 | $V_S$ | 0 | 0 |
| 4 | $V_S$ | 0 | $V_S$ | $V_S$ | $V_S$ | 0 | $V_S$ ++ | $V_S$ − − | $V_S$ − | 0 | $V_S$ | $V_S$ | 0 | 0 |

ERASE
MODE TWO

FIG. 11D

| ELECTRODE | 1 | 2 | 3 | 4 | 1 | 2 | 3 | 4 | 1 | 2 | 3 | 4 | E | $E_0$ |
|---|---|---|---|---|---|---|---|---|---|---|---|---|---|---|
| TIME 10 | $V_S$ | $\overline{0}$ | $V_S$ | $\overline{V_S}$ | $V_S$ | $\overline{0}$ | $V_S$ | $\overline{V_S}$ | $V_S$ | $\overline{0}$ | $V_S$ - | $\overline{-}$ $\overline{V_S}$ | $V_E$ - - - | + + + $\overline{0}$ |
| 11 | $V_S$ | $\overline{V_S}$ | 0 | $\overline{V_S}$ | $V_S$ | $\overline{V_S}$ | 0 | $\overline{V_S}$ | $V_S$ | $\overline{V_S}$ | 0 | $\overline{-}$ $\overline{V_S}$ | 0 + + | $\overline{-}$ $\overline{V_S}$ |
| 11′ | $V_S$ | $\overline{V_S}$ | 0 | $\overline{V_S}$ | $V_S$ | $\overline{V_S}$ | 0 | $\overline{V_S}$ | $V_S$ | $\overline{V_S}$ | 0 | $\overline{V_S}$ | $V_S$ | $\overline{0}$ |
| 11″ | $V_S$ | $\overline{V_S}$ | 0 | $\overline{V_S}$ | $V_S$ | $\overline{V_S}$ | 0 | $\overline{V_S}$ | $V_S$ | $\overline{V_S}$ | 0 | $\overline{V_S}$ | 0 | $\overline{0}$ |
| 12 | $V_S$ | $\overline{V_S}$ | $V_S$ | $\overline{0}$ | $V_S$ | $\overline{V_S}$ | $V_S$ | $\overline{0}$ | $V_S$ | $\overline{V_S}$ | $V_S$ | $\overline{0}$ | $V_S$ | $\overline{V_S}$ |

LOAD
MODE TWO

FIG. 12B

| ELECTRODE / TIME | $I_0$ | I | 1 | 2 | 3 | 4 | 1 | 2 | 3 | 4 | 1 | 2 | 3 | 4 |
|---|---|---|---|---|---|---|---|---|---|---|---|---|---|---|
| 3 | 0 (+++) | $V_I$ (---) | $V_S$ (−) | $V_S$ (−−) | 0 (++) | $V_S$ | $V_S$ | $V_S$ | 0 | $V_S$ | $V_S$ | $V_S$ | 0 | $V_S$ |
| 3' | $V_S$ (−) | 0 | $V_S$ | $V_S$ (−−) | 0 (++) | $V_S$ | $V_S$ | $V_S$ | 0 | $V_S$ | $V_S$ | $V_S$ | 0 | $V_S$ |
| 3'' | 0 | 0 | $V_S$ | $V_S$ (−−) | 0 (++) | $V_S$ | $V_S$ | $V_S$ | 0 | $V_S$ | $V_S$ | $V_S$ | 0 | $V_S$ |
| 4 | $V_S$ | 0 | $V_S$ | $V_S$ (−) | $V_S$ (−−) | 0 (++) | $V_S$ | $V_S$ | $V_S$ | 0 | $V_S$ | $V_S$ | $V_S$ | 0 |

FIG. 12C

| ELECTRODE / TIME | $I_0$ | I | 1 | 2 | 3 | 4 | 1 | 2 | 3 | 4 | 1 | 2 | 3 | 4 |
|---|---|---|---|---|---|---|---|---|---|---|---|---|---|---|
| 5 (LOAD "0") | $V_S$ | 0 | 0 | $V_S$ | $V_S$ | $V_S$ | 0 | $V_S$ | $V_S$ | $V_S$ | 0 | $V_S$ | $V_S$ | $V_S$ |
| 6 | $V_S$ | 0 | $V_S$ | $V_S$ | $V_S$ | $V_S$ | $V_S$ | 0 | $V_S$ | $V_S$ | $V_S$ | 0 | $V_S$ | $V_S$ |
| 7 | 0 | $V_I$ | $V_S$ | $V_S$ | 0 | $V_S$ | $V_S$ | $V_S$ | 0 | $V_S$ | $V_S$ | $V_S$ | 0 | $V_S$ |
| 7' | $V_S$ | 0 | $V_S$ | $V_S$ | 0 | $V_S$ | $V_S$ | $V_S$ | 0 | $V_S$ | $V_S$ | $V_S$ | 0 | $V_S$ |

FIG. 12D

| ELECTRODE / TIME | $I_0$ | I | 1 | 2 | 3 | 4 | 1 | 2 | 3 | 4 | 1 | 2 | 3 | 4 |
|---|---|---|---|---|---|---|---|---|---|---|---|---|---|---|
| 7'' | 0 | 0 | $V_S$ | $V_S$ | 0 | 0 | $V_S$ | $V_S$ | 0 (++) | $V_S$ | $V_S$ | $V_S$ | 0 | $V_S$ |
| 8 | $V_S$ | 0 | $V_S$ | $V_S$ | $V_S$ | 0 | $V_S$ | $V_S$ | $V_S$ | 0 (++) | $V_S$ | $V_S$ | $V_S$ | 0 |
| 9 (LOAD "1") | $V_S$ | $V_I$ | 0 (+++) | $V_S$ | $V_S$ | $V_S$ | 0 | $V_S$ | $V_S$ | $V_S$ | 0 (++) | $V_S$ | $V_S$ | $V_S$ |
| 9' | $V_S$ | 0 (++) | 0 (++) | $V_S$ | $V_S$ | $V_S$ | 0 | $V_S$ | $V_S$ | $V_S$ | 0 (++) | $V_S$ | $V_S$ | $V_S$ |

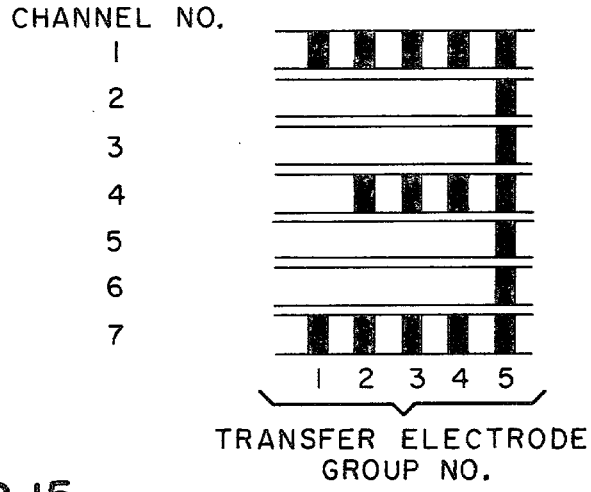
FIG.14
FIG.15
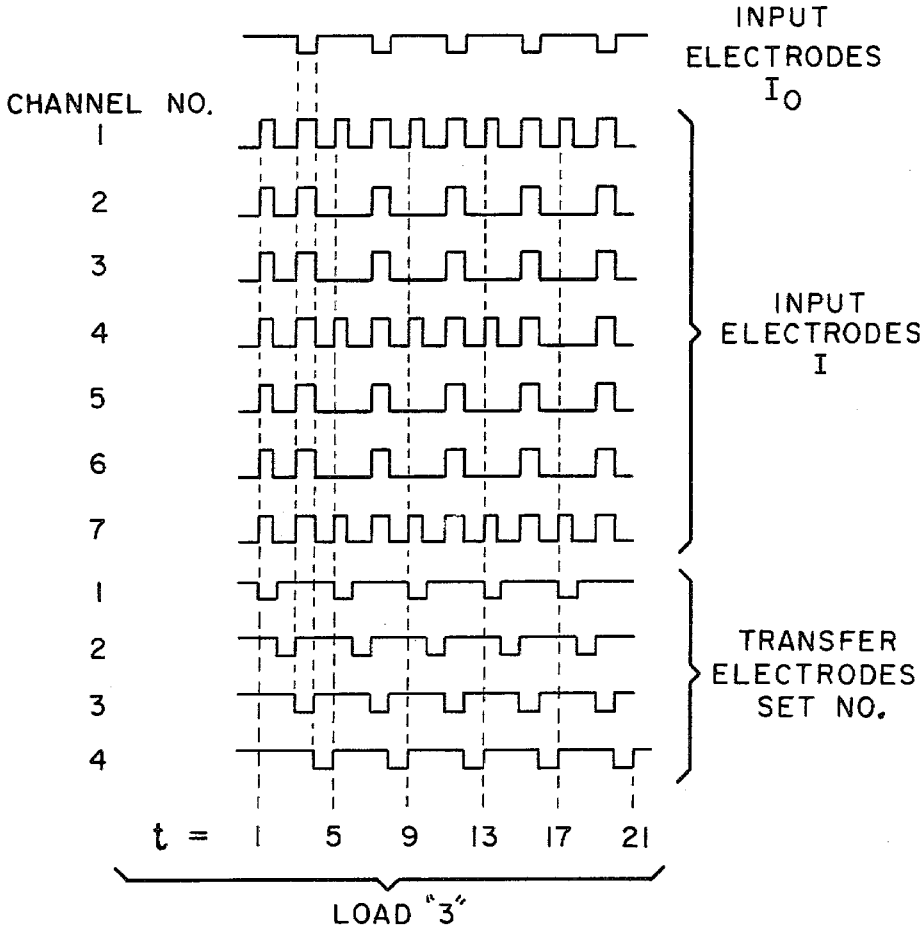

INPUT-KEEP ALIVE ARRANGEMENT FOR PLASMA CHARGE TRANSFER DEVICE

BACKGROUND OF THE INVENTION

This invention relates to gas ionization devices and, more particularly, to gas ionization devices having the capability of shifting or transferring data.

Gas ionization (plasma) charge transfer devices of the type described in U.S. Pat. No. 3,781,600, issued Dec. 25, 1973, to Coleman and Kessler have the advantage of wide flexibility of use. One method of fabricating such devices is explained in U.S. Pat. No. 3,810,686, issued May 14, 1974, to Coleman. Both patents are assigned to NCR Corporation, and are incorporated by reference. Such devices are operable as memory registers, as recirculating registers or as display devices, and either in a static or a dynamic mode. As described in the above Coleman and Kessler U.S. Pat. No. 3,781,600, a linear charge transfer channel can be operated in parallel with similar channels to form alphanumeric characters and can be expanded to increase the number of characters in a line without increasing the address electronic cost.

The plasma charge transfer device described in the Coleman and Kessler patent is shown in FIG. 1 in the form of a four-phase shift register 10. The shift register 10 comprises enclosure-forming plates 12—12 of any suitable dielectric material, such as clear glass, which define a channel 13 containing an ionizable gas such as neon and nitrogen. A plurality of transfer electrodes 14—14 (which may be transparent) are located on inner walls 16—16 of the plates opposite one another in parallel, but laterally offset relationship to subject the ionizable gas to an electric field when a suitable potential is applied across any two opposing electrodes.

Input electrode I and erase electrode E are located at opposite ends of the linear transfer electrode array. In the embodiment shown, all transfer electrodes 14—14, but not the input electrode I or the erase electrode E, are coated with a dielectric layer 18. The ionizable gas between any two adjacent opposing electrodes, including input electrode I and the nearest opposite transfer electrode, or the erase electrode E and the nearest opposite transfer electrode effectively forms a gas cell that is dischargeable when subject to a suitable potential.

Binary information is entered into the device 10 at the first cell, which is formed between the input electrode I and the nearest electrode 1. Whether the binary information entered at a particular clock time is a 1 or a 0 depends upon whether or not the voltage across the first cell exceeds the gas discharge or firing voltage, $V_f$. The binary information is stepped along the device by the transfer electrodes 14—14 to a display position or to an output position at the opposite end of the device, then is shifted out of the device at the erase electrode E.

Operation of the device 10 is controlled by the pulsing and magnitude of the voltage, $V_i$, applied to the input electrode, the voltage $V_s$ applied to the transfer electrodes, and the voltage $V_e$ applied to the erase electrode, and by the magnitude of the voltage $V_{wc}$. $V_{wc}$ results from the charge $Q_{wc}$ deposited on the dielectric walls 19—19 by the firing or discharge of a cell. These voltages are chosen so that:

$$V_i > V_f \quad (1),$$

$$V_s < V_f \quad (2),$$

$$V_i - V_s < V_f \quad (3),$$

$$V_s + V_{wc} > V_f \quad (4).$$

As indicated by equations (1), (2) and (4), input voltage $V_i$ is greater than the discharge voltage $V_f$, and sustaining voltage $V_s$ is less than $V_f$ and will not cause discharge unless combined with $V_{wc}$. A combination of voltages, gas compositions, and gas pressures suitable for the operation of the shift register 10 is given here by way of example only. The voltages are $V_f \sim 180$ v, $V_i \sim 200$ v, and $V_s \sim 160$ v. A typical pulse width is 20 microsec. The ionizable gas is 100% Ne. The gas pressure is about 300 millimeters of mercury.

The device 10 is arranged to receive digital information every fourth clock time, at t=1, 5, 9, etc. The transfer electrodes 14—14 are connected as four sets—1, 2, 3, 4—each of which is normally maintained at $V_s$, and is pulsed to 0 v. every fourth clock time. The electrode sets 1, 2, 3 and 4 are pulsed to 0 v. at t=1, 5, 9, etc.; t=2, 6, 10, etc.; t=3, 7, 11, etc.; t=4, 8, 12, etc.; respectively, and are maintained at $V_s$ at other times. Thus, if the input electrode I is pulsed to $V_i$ at any time other than t=1, 5, 9, etc., the voltage $V_s$ on electrode 1 opposes $V_i$ and equation (3) applies to preclude the first cell from discharging.

For convenience, each member of a group of four adjacent transfer electrodes 1, 2, 3, 4 is identified by a subscript which is the group number. The group numbers are arranged in ascending order from the input end to the erase end of the channel 16. The group nearest the input electrode is thus $\mathbf{1}_1$, $\mathbf{2}_1$, $\mathbf{3}_1$, $\mathbf{4}_1$,; the last group is $\mathbf{1}_n$, $\mathbf{2}_n$, $\mathbf{3}_n$, $\mathbf{4}_n$. See FIG. 1.

To enter a digital "1" into the device 10 at time t=1, 5, 9, etc., the input I is taken to $V_i$ so that, with the electrodes 1 at 0 v., equation (1) applies to the first cell I-$\mathbf{1}_1$, and discharge occurs there. If a digital "0" is to be input, the input electrode I is allowed to remain at 0 v. The digital "1" discharge applies positive charge of voltage $V_{wc}$ to the cell wall having the lower polarity. In this case, the lower polarity wall is associated with electrode $\mathbf{1}_1$.

The wall charge shortly extinguishes the discharge. However, the timing of the 1234 sequence of transfer electrode pulsing is selected so that electrodes 2 are taken to 0 v. and electrodes 1 back to $V_s$ before the wall charge dissipates. Because of this 0 v. potential on electrode $\mathbf{2}_1$ and the $V_s$ and $V_{wc}$ voltages on electrode $\mathbf{1}_1$, equation (4) applies and the cell formed by the electrodes $\mathbf{1}_1$–$\mathbf{2}_1$ discharges. Discharge again leaves positive wall charge on the lower polarity wall, here the wall of electrode $\mathbf{2}_1$. Again, the wall charge extinguishes the discharge and the associated voltage, $V_{wc}$, is algebraically added to $V_s$ to discharge the next adjacent cell, which is formed by the electrodes $\mathbf{2}_1$–$\mathbf{3}_1$. This sequential transfer of discharge and wall charge continues as long as the sequential 1234 pulsing of the transfer electrodes prevails. Consequently, the information entered at the first cell can be transferred to a desired position within the channel or to the erase electrode E for destruction.

Note that the sequential pulsing of the transfer electrodes 14—14 occurs during the input of information as well as during transfer thereof. This permits previously entered information to be transferred serially along the device simultaneously with the entering of additional information which may occur once every four clock times of the transfer electrodes.

If it is desired to stop the shifting of information and to retain the information in place at any time, the sequence of transfer pulses is changed to what Coleman and Kessler refer to as the "hold" mode. One such sequence involves alternately pulsing two adjacent sets of the electrodes, such as sets 3 and 4, while the other two sets are maintained at a constant voltage.

A 14321234 hold sequence is taught in U.S. Pat. No. 4,051,409 issued Sept. 27, 1977 to D. G. Craycraft and assigned to NCR Corporation. The Craycraft hold sequence prevents charge build up on electrodes adjoining the display cells and thereby facilitates shifting charge information after the hold sequence without reloading.

After the load sequence, shifting is reinstated when desired by reverting to the 1234 sequence of transfer electrode pulsing.

Shifted information is erased as it reaches the erase electrode E by applying the voltage pulse sequence of the transfer electrodes 1 to the erase electrode. Upon discharge of the next to the last cell in the device (the cell formed by the electrodes $3_n$–$4_n$ adjacent the erase electrode E), positive wall charge is formed on the wall of the electrode $4_n$. Then, upon discharge of the last cell, $4_n$-E, the positive wall charge is transferred to the direct-coupled erase electrode and "extinguished" by the ground potential on the erase electrode.

The device 10 may be utilized either as a shift register memory or as a display device. The hold mode gives the device memory. When used as a shift register memory, the input pulse, resulting discharge, and associated wall charge (or their absence) represent a bit of binary information which is transferred along the device by the above-described charge transfer mechanism. As mentioned, the presence of the input pulse represents digital "1" and the absence of an input pulse represents digital "0" (or vice versa) as information is clocked into the register and transferred out. The information is transferred along the length of the device 10 until it is coupled to the output location where it can be read optically or electrically. For example, when a bit of information reaches the last cell position, the discharge there can be read optically by a conventional photodetector which produces an output signal that is read by any suitable device. Alternatively, the discharge can be read by direct electronic sensing of the charge transferred from the last electrode position to the erase electrode.

Because light is a by-product of the gas discharge, the device 10 can be used as a display in which the input pulse is transferred serially as described above. The absence of an input pulse forms an unlighted or blank cell or dot on the display, whereas an input pulse results in a lighted cell or dot. The displayed information can be loaded into the device and then held in place to provide a stationary display, or may be shifted continuously across the device. As mentioned previously, the single channel device 10 can be operated in parallel with similar devices so that the cells or dots form readable alphanumeric characters.

The plasma charge transfer device 10 of FIG. 1 is exemplary of the present state of the art in its use of three electrodes for input and keep-alive functions. The single input electrode I may be directly coupled to the ionizable gas (FIG. 1) or covered with dielectric 18 and thereby capacitively coupled to the gas (FIG. 2) in the same manner as the transfer electrodes 1, 2, 3 and 4. In this latter case, an input voltage of greater magnitude is likely required.

The pair of electrodes $KA_1$ and $KA_2$ shown in FIGS. 1 and 2 form a keep-alive cell. The keep-alive electrodes are capacitively coupled to the gas and connected to a source of alternating voltage of sufficient magnitude and frequency to repetitively discharge the gas within the keep-alive cell. This provides a sufficient supply of ionized particles to insure discharge of the cell formed by input electrode I and the first transfer electrode $1_1$ and thereby to insure the input of data into the shift register or display.

The above-described three-electrode keep alive-input arrangement is effective. There are disadvantages however. The three electrodes are somewhat cumbersome and require separate input and keep-alive circuitry. The life of the DC input electrodes can be shortened by sputtering effects. And, the large keep-alive electrodes necessitate weaving the input electrodes around them for external connection.

SUMMARY OF THE INVENTION

The invention is an improved structure for and method of operating a plasma charge transfer device of the type described in the aforementioned Coleman and Kessler, U.S. Pat. No. 3,781,600. The improved structure comprises a pair of electrodes I, $I_0$ which are capacitively coupled to the ionizable medium internal to the device channel and which combine keep-alive and input functions. This combination of functions is made possible by applicant's unique method of multiplexing the input pulses, which are selectively applied between one of the input-keep alive electrodes and the adjacent opposite transfer electrode, and the keep-alive pulses, which are applied repetitively between the pair of input-keep alive electrodes. Using this method, both keep-alive and input discharges occur without interference.

In a second aspect of the method, the keep-alive pulses are terminated after a predetermined time at which the input-keep alive cell walls are essentially charge neutral. This pulse termination technique may also be utilized with erase electrodes which are capacitively coupled to the ionizable gas and which are pulsed in synchronism with the transfer electrodes.

BRIEF DESCRIPTION OF THE DRAWING

FIGS. 8A, 8B, 9A, 9B, 10A and 10B are charts showing discharge and charge transfer in the device of FIG. 3 in relation to the electrodes and to time during operation according to FIG. 5;

FIGS. 11A–11D and 12A–12E are charts showing discharge and charge transfer in the device of FIG. 3 in relation to the electrodes and to time during the alternative erase and load modes, respectively, according to FIGS. 6 and 7;

FIG. 14 illustrates the appearance of the character "3" when displayed by the apparatus of FIG. 4; and FIG. 15 is a timing diagram showing waveforms for operating the device of FIG. 4 to form the character "3" of FIG. 9.

DETAILED DESCRIPTION

Figure 1:
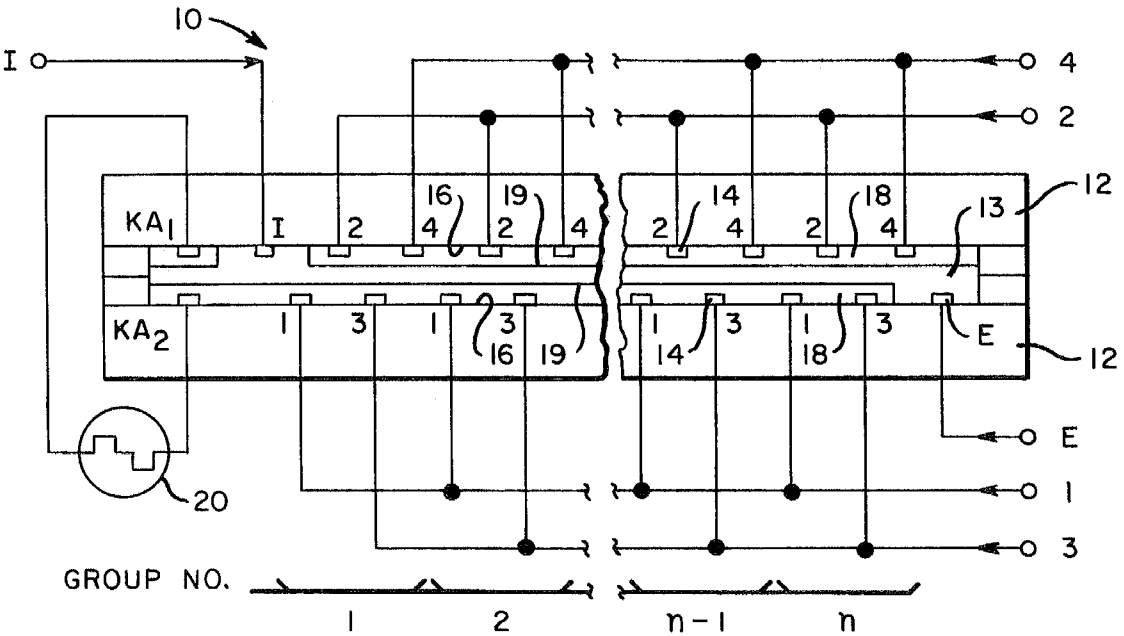
FIG. 1 PRIOR ART
FIG. 1 is a schematic cross-sectional view of a prior art plasma charge transfer device.
Figure 2:
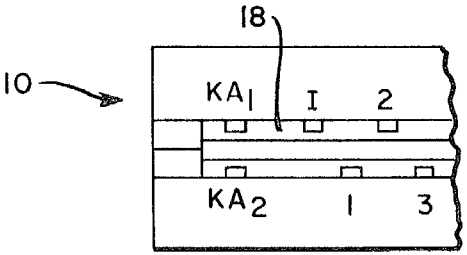
FIG. 2 PRIOR ART
FIG. 2 is a partial schematic cross-sectional view of the device of FIG. 1 showing a capacitive-coupled input.
Figure 3:
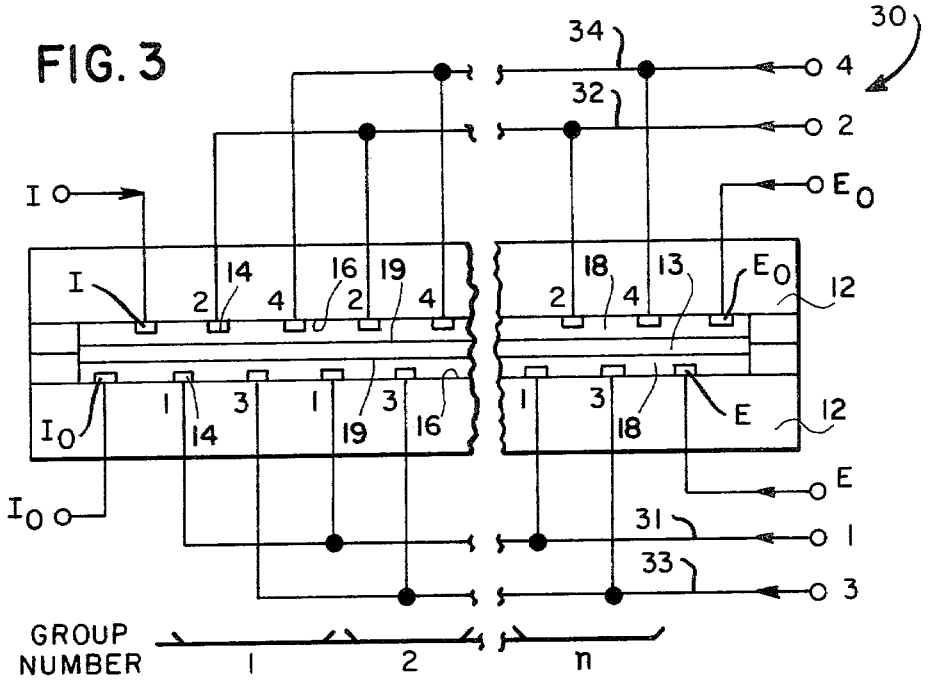
FIG. 3 is a schematic cross-sectional view of a plasma charge transfer device embodying the principles of the present invention.

FIG. 3 illustrates an exemplary plasma charge transfer device 30 embodying the principles of the present invention. The input-keep alive electrodes I, $I_0$ are fixed on opposite, inner plate walls 16—16 at one end (the left or input end) of the channel. The erase function is performed by a pair of electrodes E, $E_0$ located on opposite walls at the opposite end (the right or erase end) of the channel. Both the pair of input-keep alive electrodes and the pair of erase electrodes have a dielectric coating 18, i.e., are capacitively coupled to the ionizable gas, although the erase electrodes could be direct-coupled to the gas in the manner of Coleman and Kessler, U.S. Pat. No. 3,781,600. The components of the device 30 other than the input-keep alive and erase electrodes are common to and given the same numerical designation as the components of the Coleman and Kessler device 10 (FIG. 1).

As discussed relative to the Coleman and Kessler patent, all the electrodes 14—14 with the same number designation 1, 2, 3 or 4 are connected in common. Clock pulses are applied sequentially and repetitively to the 1, 2, 3, 4 electrode buses 31–34, respectively. Thus, a 0 volt pulse on the 1 bus 31 is applied to all electrodes 1; and a 0 volt pulse on bus 32, bus 33, or bus 34 is applied to all electrodes 2, 3 or 4. Accordingly, and as more fully described in the Coleman and Kessler patent, information is loaded into the device 30 by applying/not applying an input pulse in conjunction with a transfer electrode clock pulse. This permits shifting of several bits of information simultaneously along the channel, and the input of information simultaneously with shifting.

Figure 4:
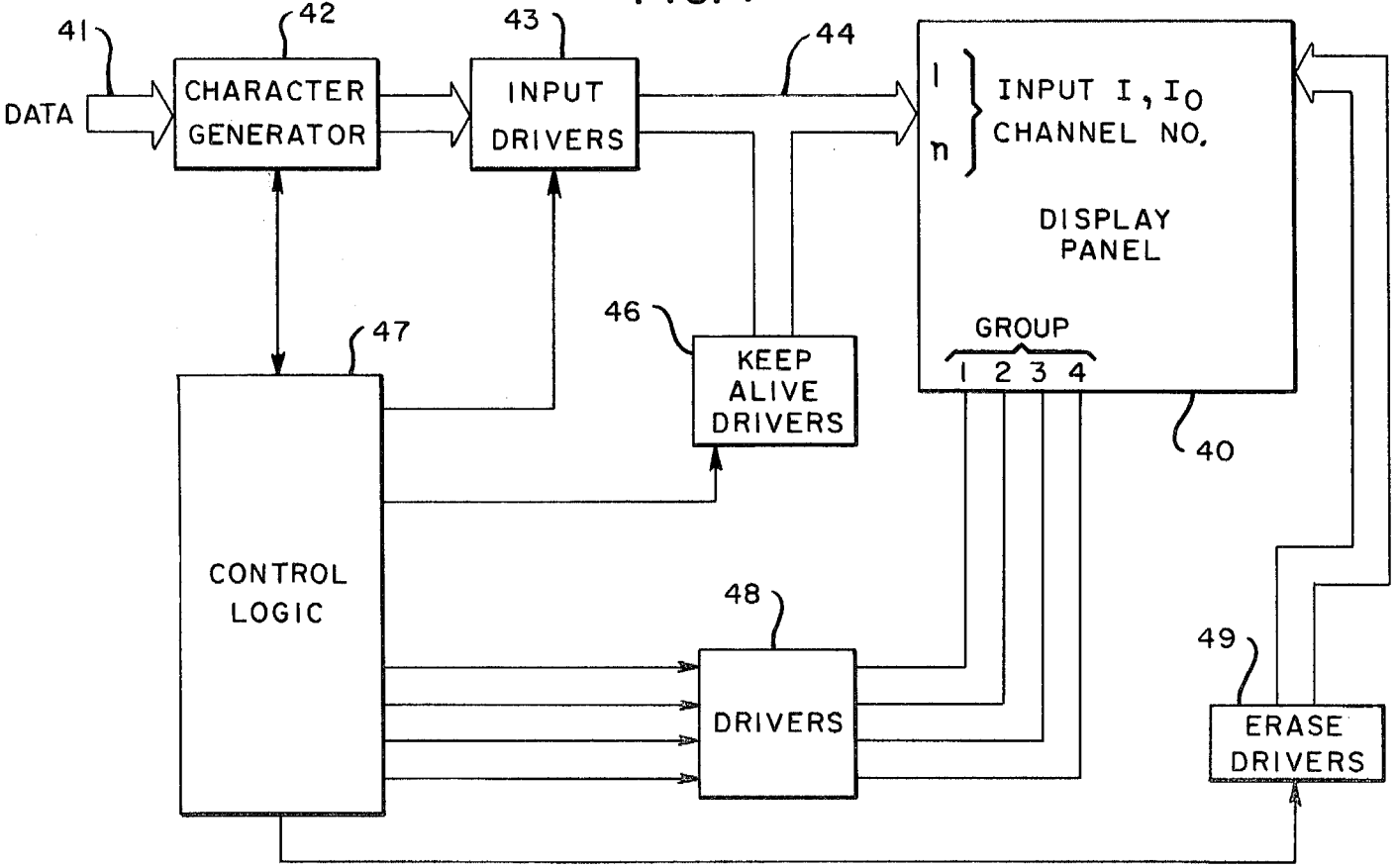
FIG. 4 is a schematic representation of a control circuit employed with a multiplicity of devices embodying the present invention.

The above description applies to a single channel device 30 and results in one or more "dots" of light along the length of the channel as pulses are applied. As used here, a "dot" of light or the lack thereof generally refers to a location within a single group of four transfer electrodes. Thus, each group of four transfer electrodes represents a single bit position. In order to display letters, numerals, etc., a plurality of channels 30 can be used together. FIG. 4 illustrates one such arrangement, a display panel 40 having n interconnected channels 30. The channels 30 are connected in parallel so that the cells of the individual channels provide horizontal dimension to alphanumeric or other characters, while the corresponding cells of the stacked array of channels provide vertical dimension to the characters.

Referring further to FIG. 4, data lines 41—41 feed character generator 42 for operating input drivers 43 associated with the seven channels 30. The input drivers 43 in turn apply input voltage $V_i$ via lines 44 to the input-keep alive electrode I for each channel. Also, keep-alive drivers 46 are connected to corresponding lines 44 to apply keep-alive pulses to the input electrodes I and $I_0$ in multiplexed operation with the input pulsing. Logic means 47 control the input drivers 43 and the keep-alive drivers 46, and also control transfer drivers 48 for pulsing the transfer electrode sets 1, 2, 3 and 4. In accordance with conventional practice mentioned above, all (or several of) the channels share the transfer drivers 48 so that transfer pulses are supplied simultaneously to each electrode 1 of every channel, each electrode 2 of every channel, etc. The control logic 47 also controls erase drivers 49 which apply erase pulses $V_s$, $V_e$ to the erase electrodes E and $E_0$.

The arrangement of FIG. 4 is very similar to the control circuitry disclosed in the aforementioned U.S. Pat. No. 4,051,409 to Craycraft. However, there are two necessary and critical differences. First, the keep-alive drivers 46 and the input drivers 43 are interconnected to permit multiplexed operation of the input pulses and the keep-alive pulses. Also, the erase drivers 49 apply $V_e$ and $V_s$ pulses to the pair of erase electrodes and do so in synchronism with the transfer electrode clock pulses. Given the circuit arrangement of FIG. 4, the waveform diagram(s) of FIG. 5, or 6 and 7 and the charge transfer charts of FIGS. 8–10 or 11 and 12, the present invention will be readily implemented by those skilled in the art.

Figure 5:
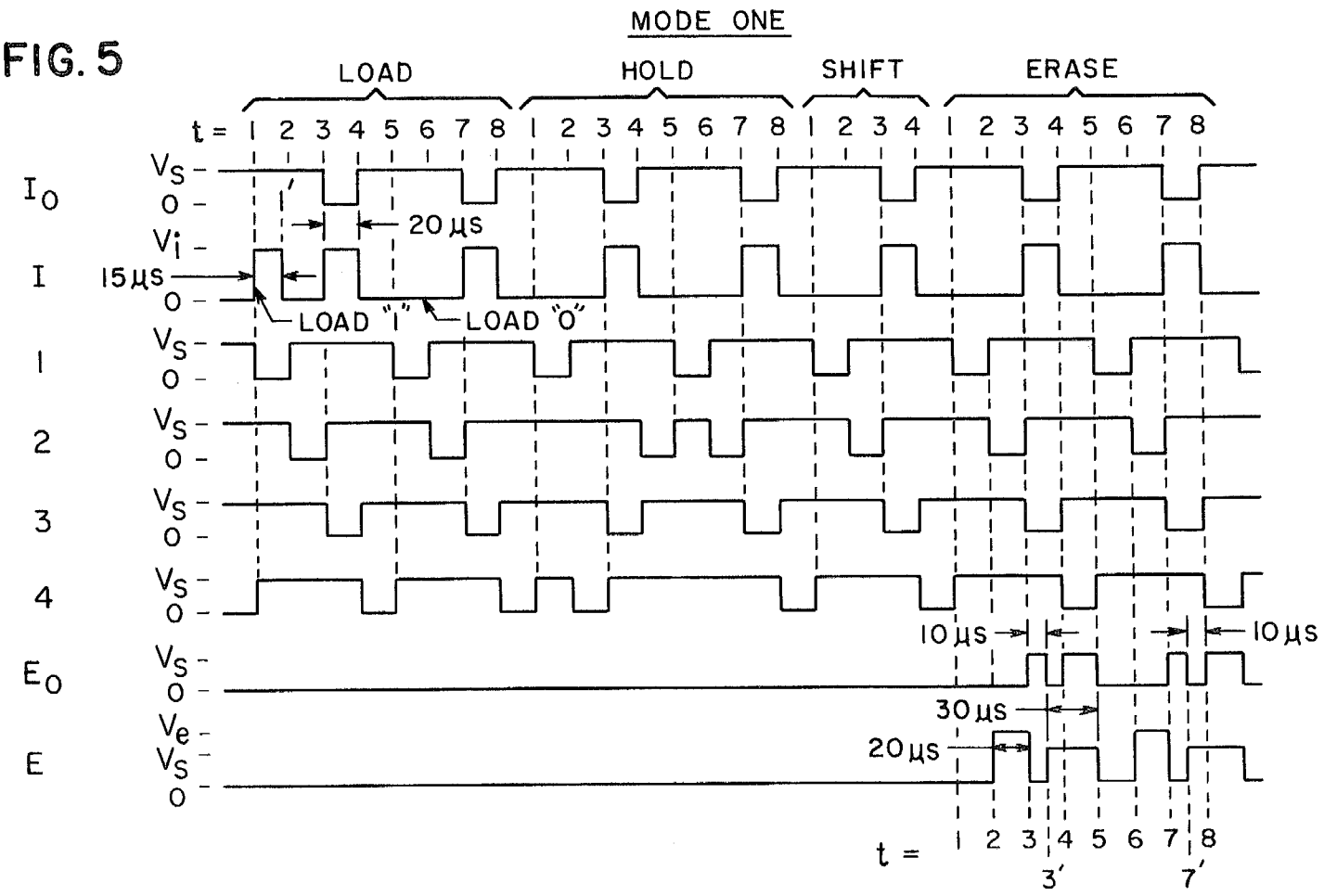
FIG. 5 is a timing diagram showing waveforms for operating the device of FIG. 3 in load, hold, shift and erase modes.

Referring now to FIG. 5, there is shown a timing diagram for loading consecutive 1, 0 bits of information into the channel 30, then holding, shifting, and erasing the information. The coordinated pulse timing diagram of FIG. 5 and charge transfer charts of FIGS. 8–10 are for channel 30 having three groups or sets of transfer electrodes g=1,2,3. The number of groups is illustrative only, and chosen solely because of space limitations.

The exemplary clock time interval is 20 microseconds (μs). Times for each mode of operation start at t=1 in FIG. 5. Accordingly, the load 1, 0 and erase modes each have times t=1, 2, . . . 8 which represent two consecutive clock time cycles. The illustrated shift mode occupies one clock time cycle. The clock sequence is changed during the hold mode as described below, but still involves four clock times per cycle. Two clock cycles are shown for the hold mode. The number of clock cycles shown is illustrative only.

The keep-alive function is implemented by twice reversing the polarity of the voltage applied across the input-keep alive cell at the third and fourth clock times of each clock time cycle. This dual polarity reversal occurs in FIG. 5 during loading at load times t=3 and 4; 7 and 8. Input $I_0$ is normally at $V_s$ and is switched from $V_s$ volts to 0 v. at t=3 and t=7, then is returned to $V_s$ at t=4 and t=8. Input I, which is normally at 0 volts, is switched to $V_i$ v. at t=3 and t=7, then is returned to 0 v. at t=4 and t=8.

As shown in the pulse transfer charts of FIG. 8, each polarity reversal at load t=3, 7, etc. produces a discharge across the cell defined by I-$I_0$. These discharges provide ionized particles to facilitate discharge between the input electrode I and the first transfer electrode for loading information onto the transfer electrodes.

Referring again to FIG. 5, keep-alive discharges are not needed during the hold, shift (unless loading is being done also), and erase operations. However, the keep-alive discharging may be continued during these modes without interference with the operation of the device.

Information loading is performed by selectively applying/not applying 15 μs input pulses at load clock times t=1, 5, etc. between the keep-alive pulses in conjunction with the transfer electrode pulsing. From FIG. 5, the transfer electrode sets are taken to 0 volts, one transfer electrode set per clock time, in the sequence 1234. The illustrated two load clock cycles thus involve twice pulsing each transfer electrode to 0 v. All electrodes 1 are pulsed to 0 v. at load clock times t=1, 5, etc. Similarly, electrodes 2; 3; and 4 are pulsed to 0 v. at the respective load clock times 2, 6, etc.; 3, 7, etc.; and 4, 8, etc. This transfer pulse sequence is also used for the shift and erase modes of operation.

Referring further to FIG. 5, assume that previous keep-alive pulsing has left sufficient wall charge on the wall 19 of electrode I to insure loading, as shown at load time t=0, FIG. 8. To load a 1 bit onto the shift register, at load clock time t=1 input electrode I is switched to $V_i$ v. for about 15 microseconds in conjunction with the switching of electrodes 1 to 0 v. Equation (1) holds, the cell formed by I-$1_1$ is fired, and positive and negative wall charges (indicated by + and −) resulting from the discharge are attracted to the dielectric walls 19 of the cell I-$1_1$. The positive charge is attracted to the wall having the lower potential, here the wall of electrode $1_1$. The associated wall charge potential $V_{wc}$ opposes the potential $V_i$ and quickly extinguishes the discharge, leaving the wall charge on the cell walls as shown at load time 1.

It is emphasized that the discharges shown at the various times in FIGS. 8–10, (for example load time 1) are based upon the wall charge condition which existed at the preceding clock time, (in this case, load time 0), but the wall charge shown at each time is the wall charge which results from the discharge shown at the same time. Also, the ions associated with each discharge at least partially neutralize any residual charge on adjacent electrodes, so that subsequent discharges restore any disruption of charge neutrality resulting from a previous discharge. Finally, the + and − symbols are intended merely as approximations of the wall charge and its location.

Input I is switched back to 0 volts at load time 1′ (after about 15 μs), causing another keep-alive discharge, and reducing the charge on electrode 1.

Figure 8B:
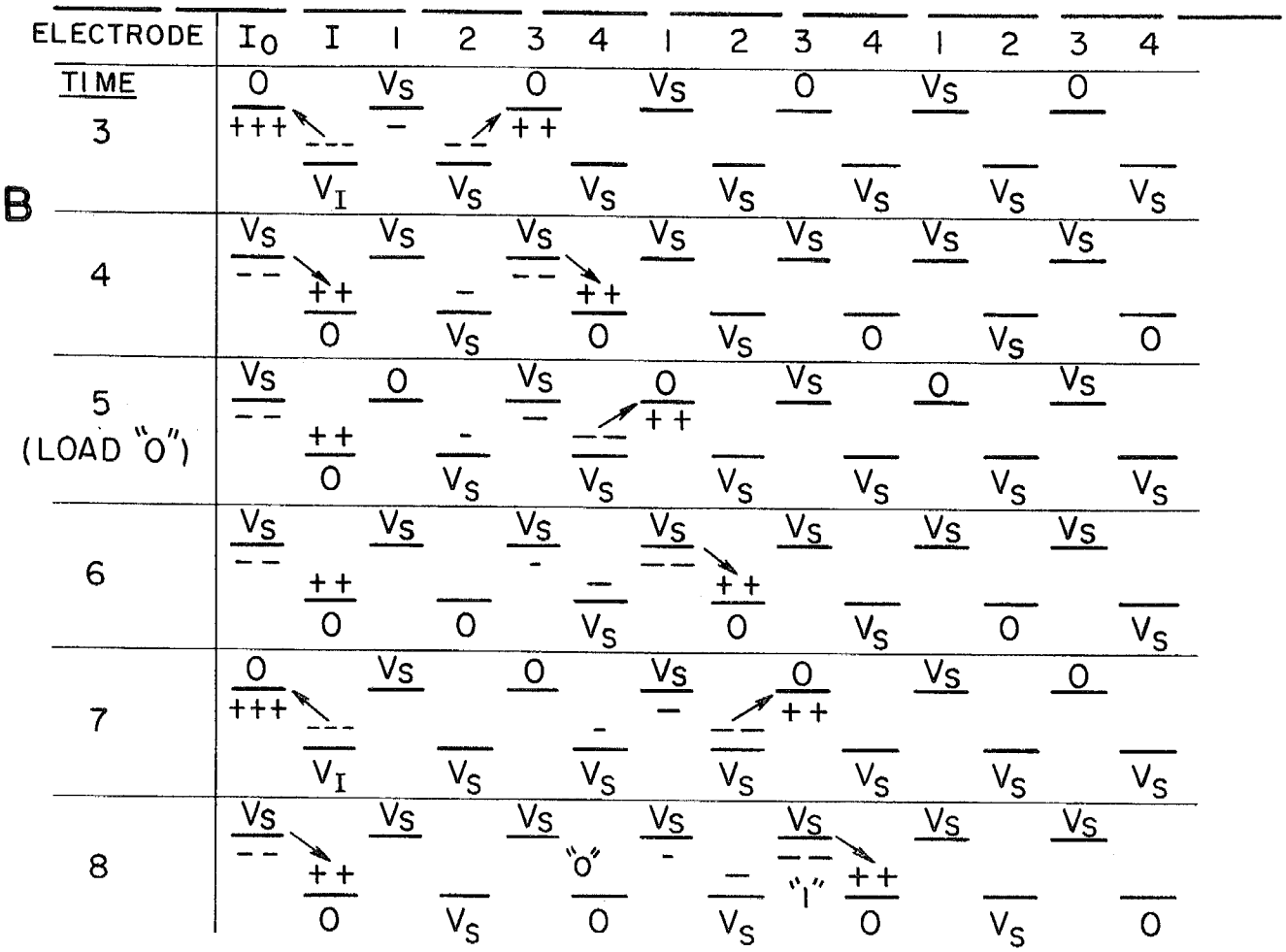

At load time t=2, transfer electrodes 1 are returned to $V_s$ and electrodes 2 are switched to 0 v. The wall charge associated with electrode $1_1$ (see load time 1′) adds to the potential $V_s$ on the electrodes 1 in accordance with equation (4) to discharge the cell $1_1$–$2_1$. Again, the positive wall charge collects on the lower potential wall of the cell, (electrode $2_1$), extinguishing the discharge. This process of switching the transfer electrodes to 0 v. to discharge a cell and transfer wall charge occurs again at clock times t=3 and t=4 (FIG. 8B). As a result, the positive charge is shifted to the wall of electrode $4_1$.

Note that the keep-alive pulses that occur at load times 3 and 4 refresh the wall charge on I-$I_0$ in preparation for the next loading cycle, in addition to providing "priming" ions for the next loading cycle, but do not interfere with the transfer of information described above.

To load a 0 bit at load t=5, input electrode I is allowed to remain at 0 volts to preclude discharge between I and $1_1$, which is switched to 0 v. at load t=5 in accordance with the transfer electrode clock pulsing. At load t=5, 6, 7, and 8 (FIG. 8B), discharge and charge transfer occurs across cells $4_1$–$1_2$, $1_2$–$2_2$, $2_2$–$3_2$, and $3_2$–$4_2$, respectively, in the manner described previously to transfer the digital 1 to cell $3_2$–$4_2$. In like manner, the 0 is transferred to cell $3_1$–$4_1$. It should be noted that the 0 bit is characterized by a lack of discharge and a lack of wall charge transfer during its entry and "passage."

If desired, information bits 1 or 0 could be entered every subsequent fourth clock time. Alternatively, if the desired information form is the light from the discharge, a transparent plate or plates 12 (FIG. 3) can be used to display information in the form of lighted dots/unlighted dots.

Figure 9B:
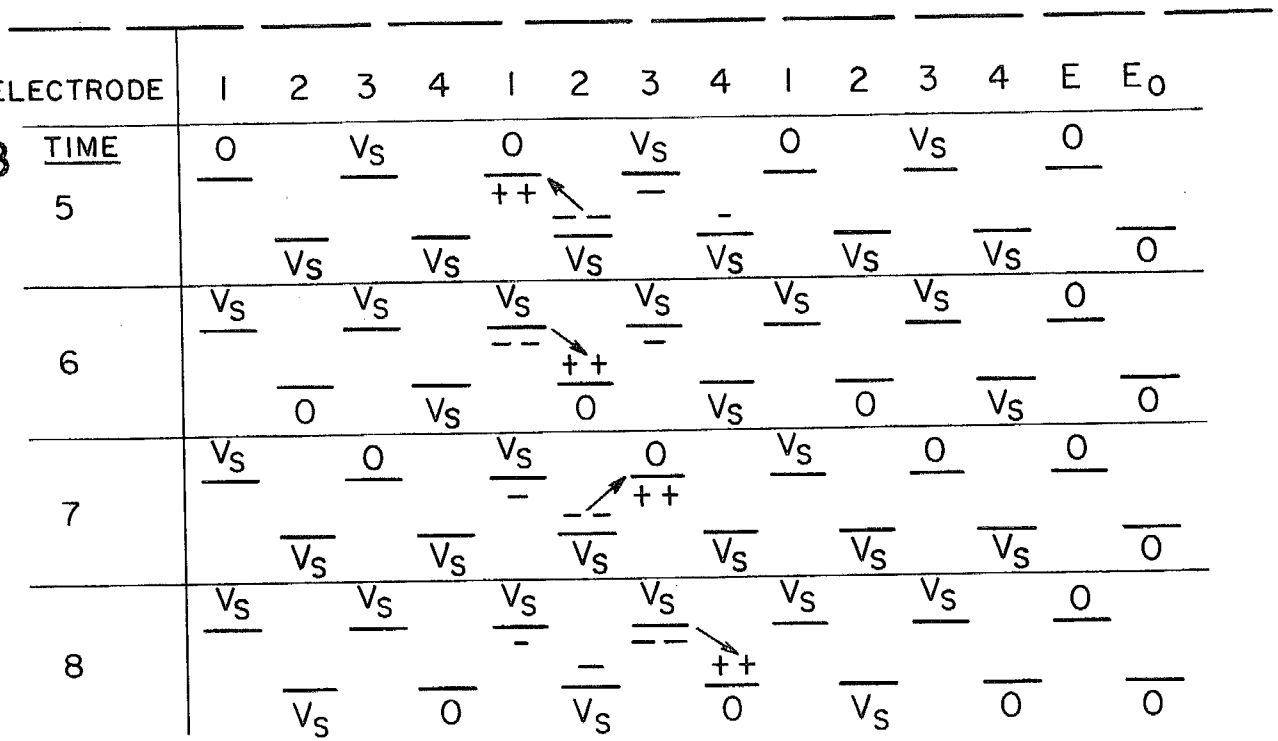

The hold mode illustrated in FIG. 9 is accomplished by applying the Craycraft 14321234 sequence of 0 v. pulses to the transfer electrodes. A single hold cycle thus utilizes eight clock times and five different electrodes. Referring to FIG. 9A and also to FIG. 5, at hold t=1, transfer electrodes 1 and 4 are switched to 0 v. and $V_s$ v., respectively, and with positive wall charge on electrode $4_2$ from the previous discharge at hold t=8, equation (4) holds and cell $4_2$–$1_3$ discharges. At hold t=2, the transfer electrodes 1 are switched back to $V_s$ and the electrodes 4 are taken to 0 v. so that the wall charge on $1_3$ causes the cell $4_2$–$1_3$ to fire in the reverse direction. The the rest of the hold sequence, 321234, to discharge the cells $4_2$–$3_2$, $3_2$–$2_2$, $2_2$–$1_2$, $1_2$–$2_2$, $2_2$–$3_2$, $3_2$–$4_2$ in sequence and thereby return the positive wall charge to $4_2$ after the discharge at hold t=8. See also FIG. 9B. The hold sequence is useful, for example, to display information in the form of lighted messages at a chosen location along the length of the channel 30.

This five electrode sequence and the four electrode sequence also taught in Craycraft are preferred hold sequences, for they facilitate subsequent shifting without reloading. The Craycraft patent is incorporated by reference.

The hold sequence is easily coordinated with the preceding and following sequences. As illustrated in FIG. 5, the preceding load sequence is completed by switching transfer electrodes 4 to 0 v. at load time t=8 (or at the end of the last four-clock-time cycle of the load sequence) immediately preceding the first hold time. Also, the following shift or erase sequence is initiated by switching the transfer electrodes 1 to 0 v. to commence the standard 1234 transfer electrode sequence.

A shift cycle is identical to the "load 0" cycle, i.e., the pulsing required is the 1234 transfer electrode pulse sequence illustrated in FIG. 5. This cycle is used to transfer information to a desired display location or to the end of the register in preparation for the erase operation. For example, after loading the 1 and 0 bits onto the first two bit positions of the three bit channel 30, and holding the information if desired, one shift cycle is necessary to transfer the digital information into position to initiate erasing. The charge associated with the 1 bit would be transferred to electrode $4_3$; the 0 bit would be transferred to electrode $4_2$.

Figure 10A:
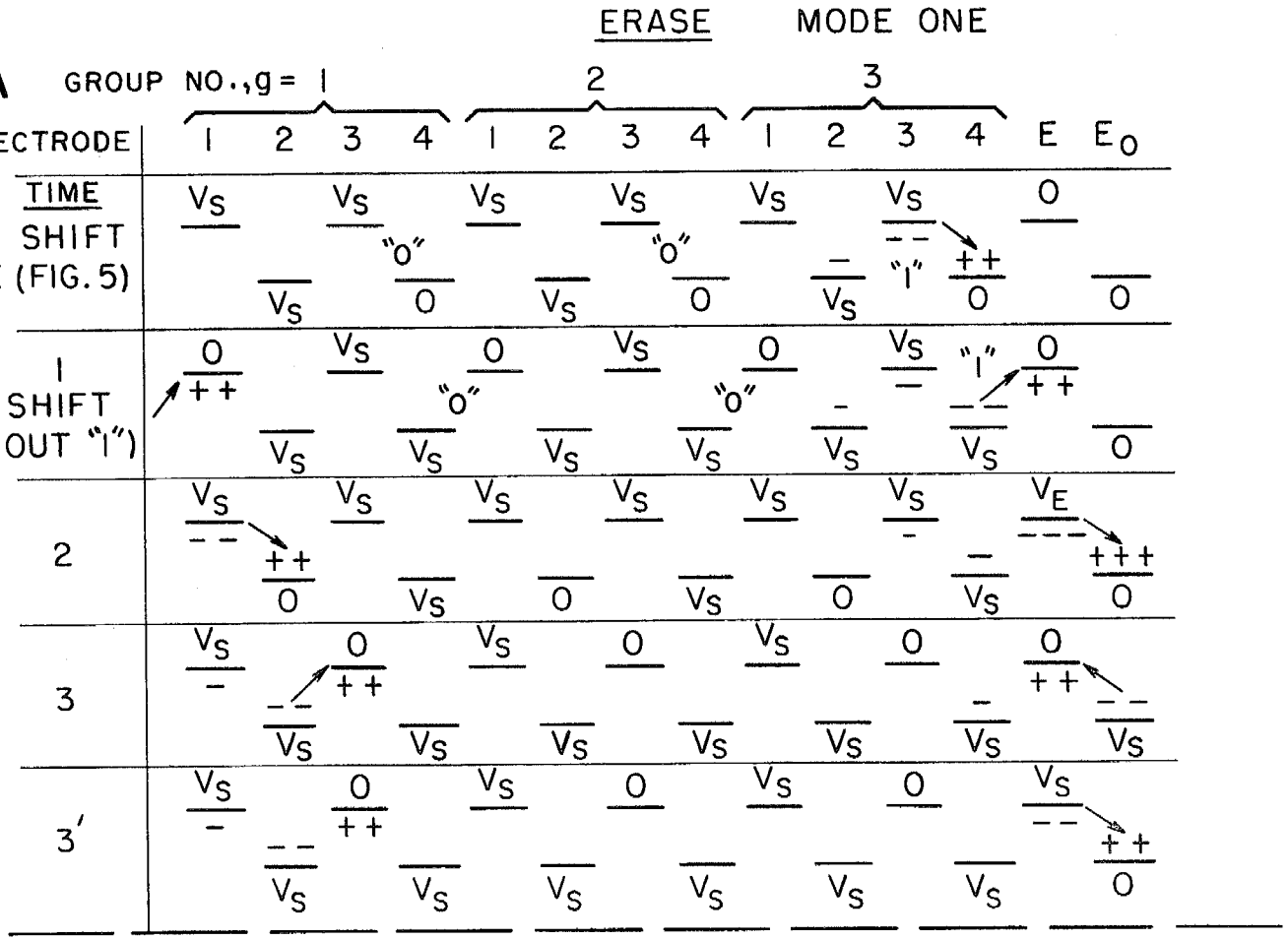
Figure 10B:
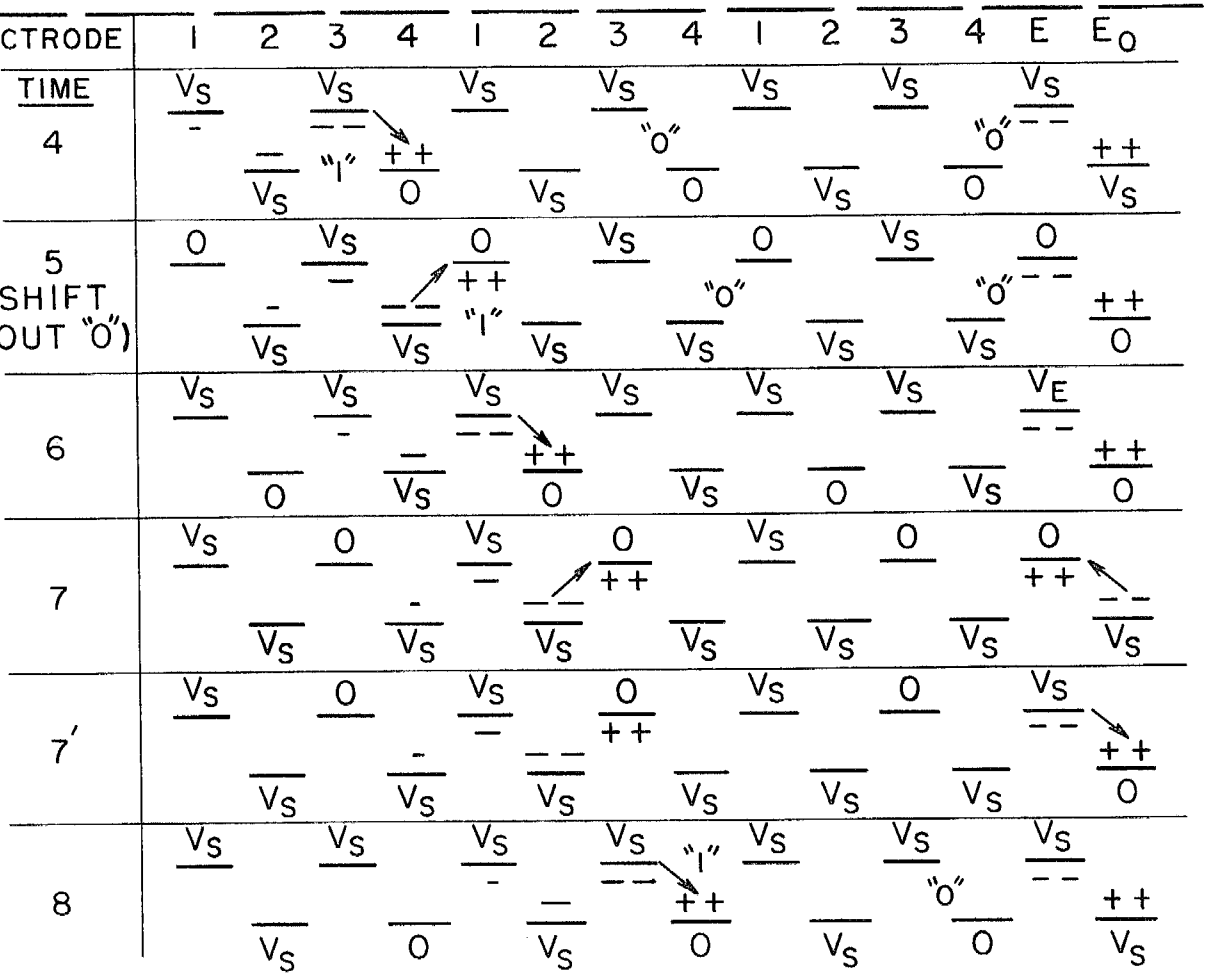
Figure 11A:
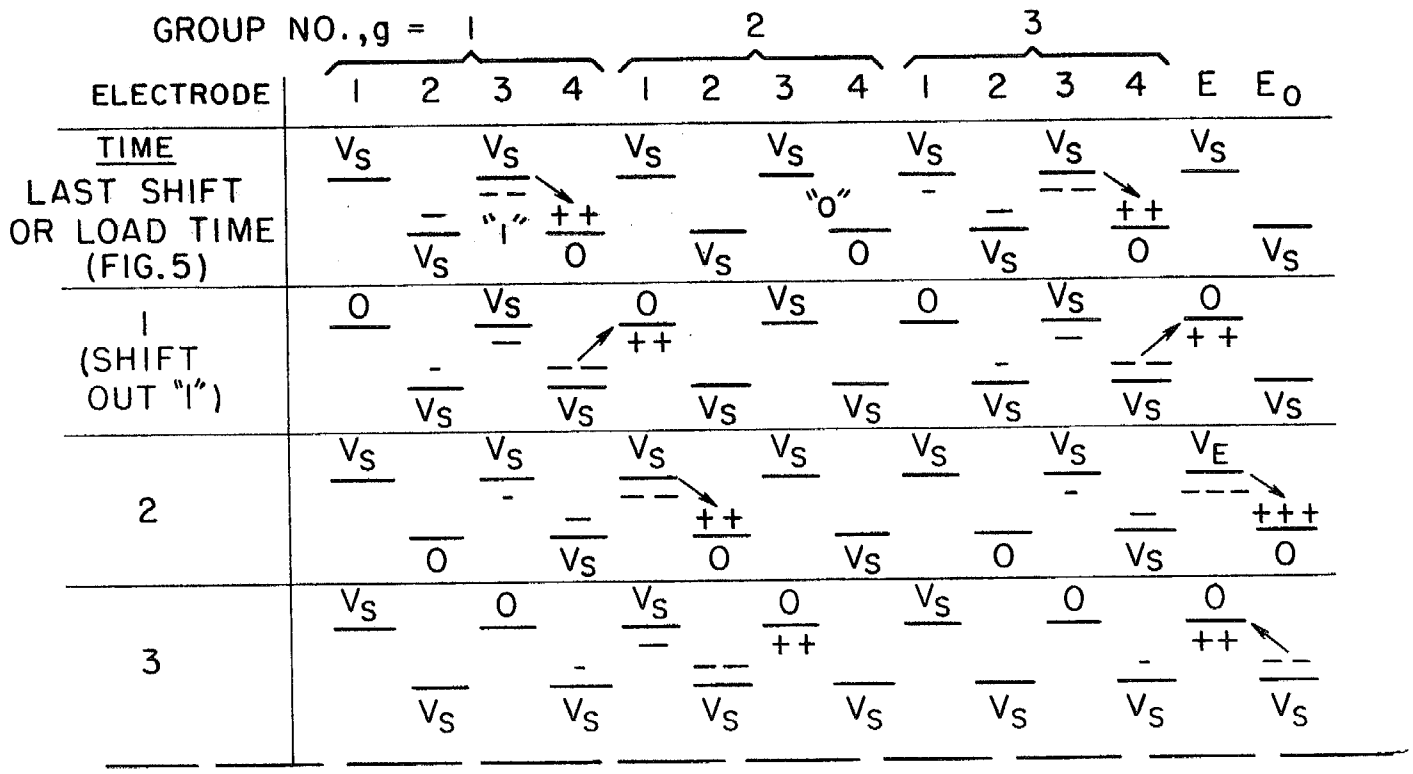
Figure 11B:
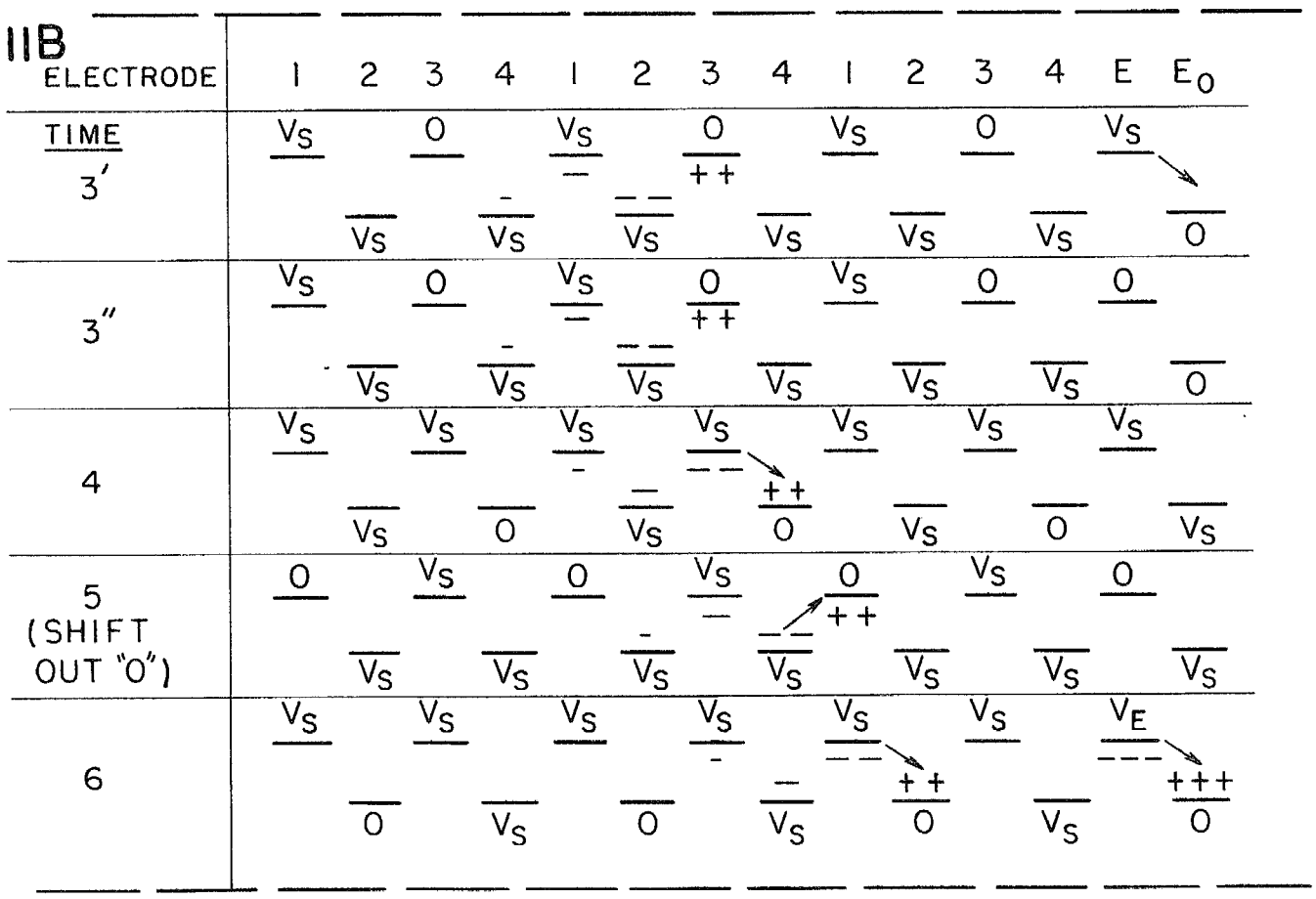

The erase sequence involves coordinated pulsing of the E and $E_0$ electrodes in synchronization with the normal transfer pulsing of the transfer electrodes. Alternative erase modes are shown in FIGS. 10 and 11. The first mode, shown in FIGS. 10A and 10B, sets the polarity of any residual wall charge on E-$E_0$ to permit proper subsequent discharge and erase operation. The same aim is accomplished during the second mode, shown in FIGS. 11A and 11B, by eliminating residual charge on E-$E_0$.

First, consider use of the first erase mode for shifting out or erasing the "1" bit. At the last shift clock time (FIG. 5) electrode $4_3$ was taken to 0 v. to discharge the cell $3_3$–$4_3$ and apply the positive wall charge associated with the "1" bit to electrode $4_3$. This condition is represented in the first time-frame of FIG. 10A.

At the first erase clock time, electrode $4_3$ is switched from 0 v. to $V_s$ v., while E is at 0 v. Because of the positive wall charge remaining on electrode $4_3$ from the last shift clock time, equation (4) applies and the cell $4_3$-E discharges. This transfers the positive wall charge from $4_3$ to E at erase t=1.

At erase t=2, electrode E is switched to $V_e$ v., and $E_0$ remains at 0 v. The cell E-$E_0$ is discharged, transferring positive wall charge to $E_0$.

Next, at erase t=3, during pulses of about 10 microseconds duration (from t=3 to 3') E is switched to 0 v. and $E_0$ to $V_s$ v. to fire the cell $E_0$-E in the reverse direction. This restores the positive wall charge to electrode E.

Then, at erase time 3', potential on electrode E is changed from 0 v. to $V_s$ and stays at $V_s$ for 30 μs until t=5 while $E_0$ is also changed from $V_s$ to 0 v. for 10 μs until t=4, at which time it is again changed from 0 v. to $V_s$ for 20 μs until t=5. This discharge at t=3 the cell E-$E_0$ in the original direction and leaves positive wall charge on $E_0$ and negative wall charge on E. This last pulse concludes the first, four clock-time erase cycle, and places the charge on E and $E_0$ in the proper polarity for the next erase cycle. See clock t=4, FIG. 10B.

The four clock-time erase cycle is repeated to erase the "0" bit. This next cycle is shown at erase t=5–8 of FIGS. 5 and 10B. During the second erase cycle, the erase discharges occur at erase times 7 (clock t=3) and 7' (clock t=3.5). The second of these discharges places positive and negative wall charges on $E_0$ and E, respectively, to prepare $E_0$ and E for the next erase cycle.

FIGS. 10A and 10B also illustrate the shifting into erase position of "0" and "0" bits which were entered into the channel subsequent to the "1" and "0" shown in FIGS. 5 and 8.

It will be noted that the erase electrodes need not be pulsed during the other modes of operation.

Figure 6:
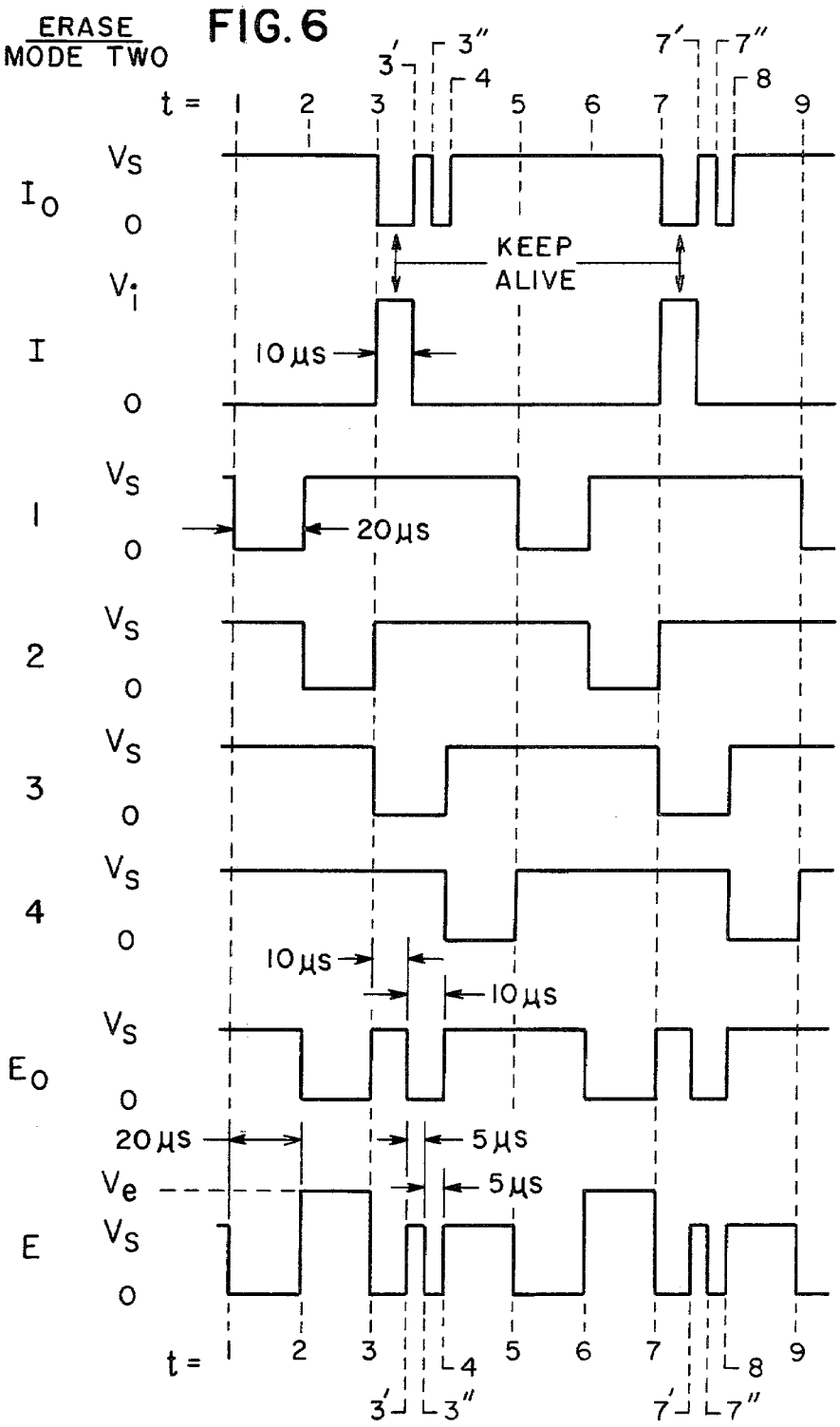
FIGS. 6 and 7 are timing diagrams showing wave forms for operating the device of FIG. 3 in an alternative erase mode and an alternative load mode, respectively, which leave the erase cell and the input-keep alive cell charge neutral.

FIGS. 6 and 11A, B show the timing diagram and charge transfer charts, respectively, for the alternative, charge-neutral erase operation, erase mode II. Erase mode II differs from mode I, shown in FIGS. 5 and 10, in that the $V_s$ potential on electrode E is briefly dropped to 0 v. at predetermined erase times 3", 7", etc. In contrast, during mode I, E stays at $V_s$ from 3' to 5, 7' to 9, 11' to 13, etc. With $E_0$ at 0 v. during mode I erase times 3'–4, 7'–8, 11'–12, etc., the discharge across E-$E_0$ is of like duration and leaves the previously-described wall charges on E and $E_0$ at erase t=4, 8, 12, etc. These charges permit proper functioning of the erase electrodes during subsequent erase cycles. Dropping the E potential to 0 v. in mode II is done at the predetermined times 3", 7", 11", etc. at which the discharge has just brought the dielectric-covered walls of E-$E_0$ to charge neutrality. Thus, there is essentially no wall charge on E-$E_0$ at mode II erase t=4, 8, 12, etc. and these electrodes are again ready for the next erase cycle. For the exemplary plasma display channel 30, E can be dropped to 0 v. at 3" (or 7", 11", etc.), i.e., time 3'+5 microseconds. Note that depending on the gas mixture and gas pressure, the time for erasure can be less than one microsecond.

Figure 11C:
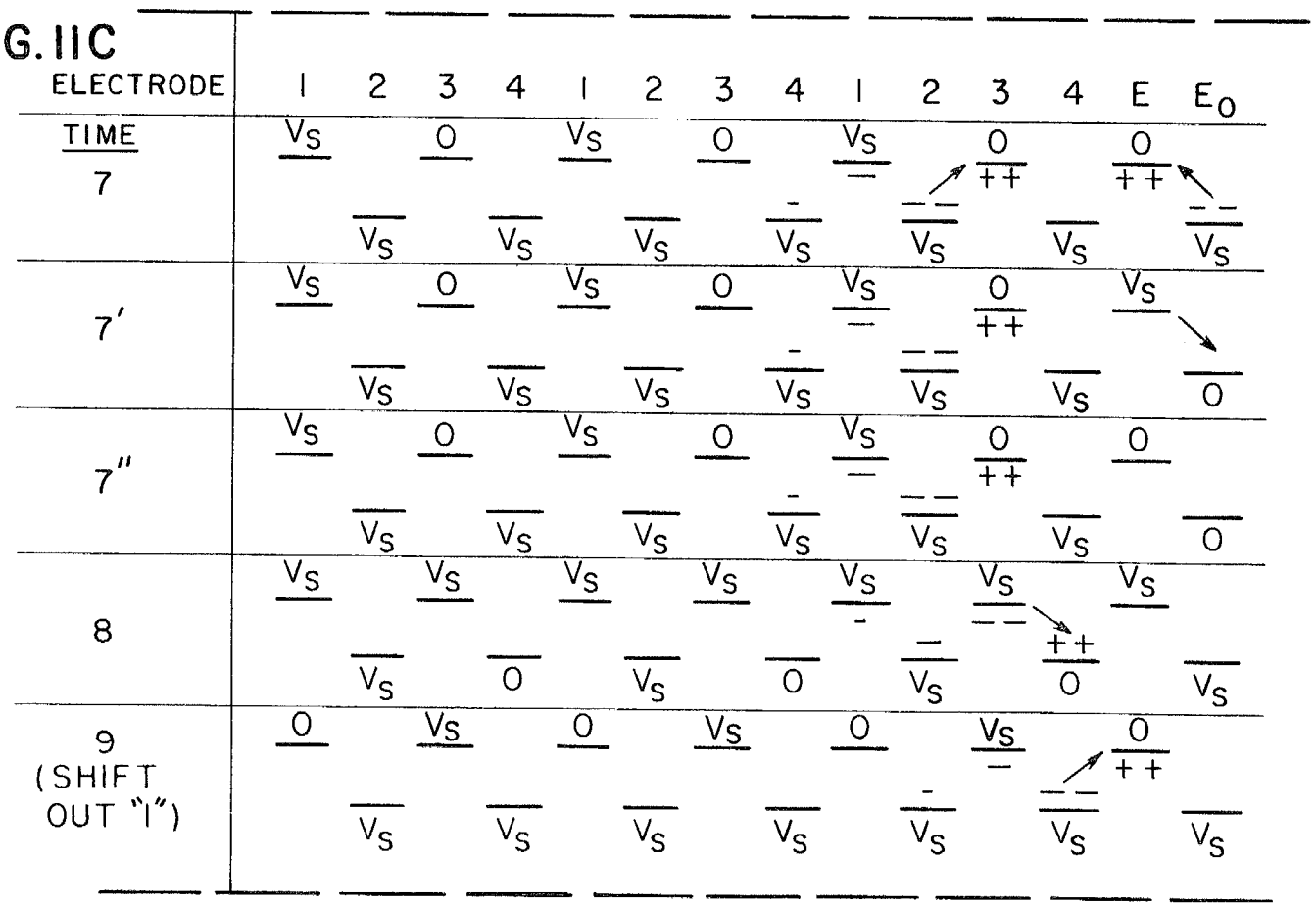

The positive and negative charge on $E_0$ and E at mode I erase t=4 and 8 is shown in FIG. 10B, and the lack of charge which occurs when the discharge is cut short at mode II erase t=3", 7", and 11" is shown in FIG. 11B–D. Thus, of the three possible erase electrode charge situations—the charge on the erase electrodes (1) facilitating or (2) hindering erasing, or (3) the erase electrodes having essentially no charge, i.e., being charge-neutral—modes I and II provide the first and third, desirable situations.

Figure 13:
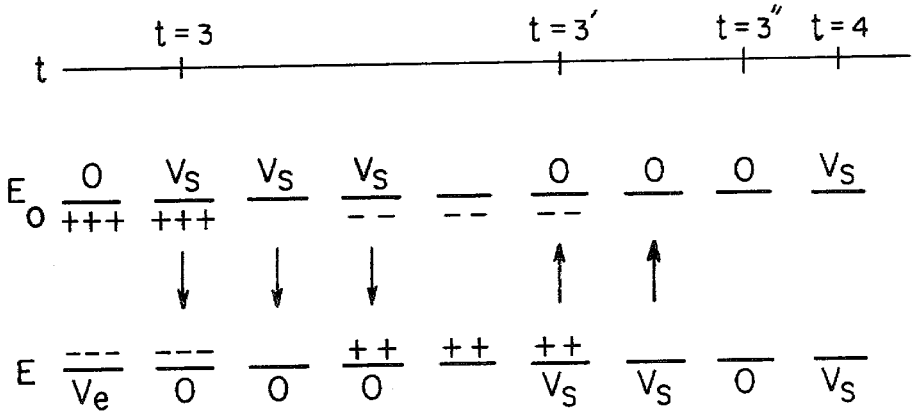
FIG. 13 is a schematic representation of the erase cell of FIG. 3 at various times just before, during and after a charge-neutral erase sequence.

The effect of the discharge-quenching pulse of erase mode II is shown schematically in FIG. 13. FIG. 13 is a representation of the discharge and charge state of the capacitive coupled $E_0$-E cell just before, during and after one erase sequence, illustratively from erase t=2+ to erase t=4. Just before and at erase t=3, there is positive and negative wall charge on $E_0$ and E as the result of the discharge at erase t=2. At erase t=3, the potential across the cell is reversed. With $V_s$ voltage on $E_0$, the wall charge is additive to the applied voltage so that equation (4) applies and the cell is discharged. The discharge gradually reverses the polarity of the wall charge across the cell until, before t=3', the reversed wall charge quenches the discharge. Then, at erase t=3", the potential is again reversed. With $V_s$ voltage on $E_0$, the wall charge is additive to the applied voltage so that equation (4) again applies and the cell is discharged in the reverse direction. Again the discharge commences reversing the wall charge. At t=3", when there is no or very little wall charge on the cell, the potential is removed. This stops the discharge and the wall charge reversal, so that at erase t=4, the charge-neutral erase cell E-$E_0$ is ready for the next erase sequence. (In mode I, the potential applied across the erase cell continues until sufficient reversed-polarity wall charge is built up to quench the discharge. As stated previously, the polarity of this wall charge is such that normal load operation can continue. See FIG. 10B, t=4, 8.)

Figure 7:
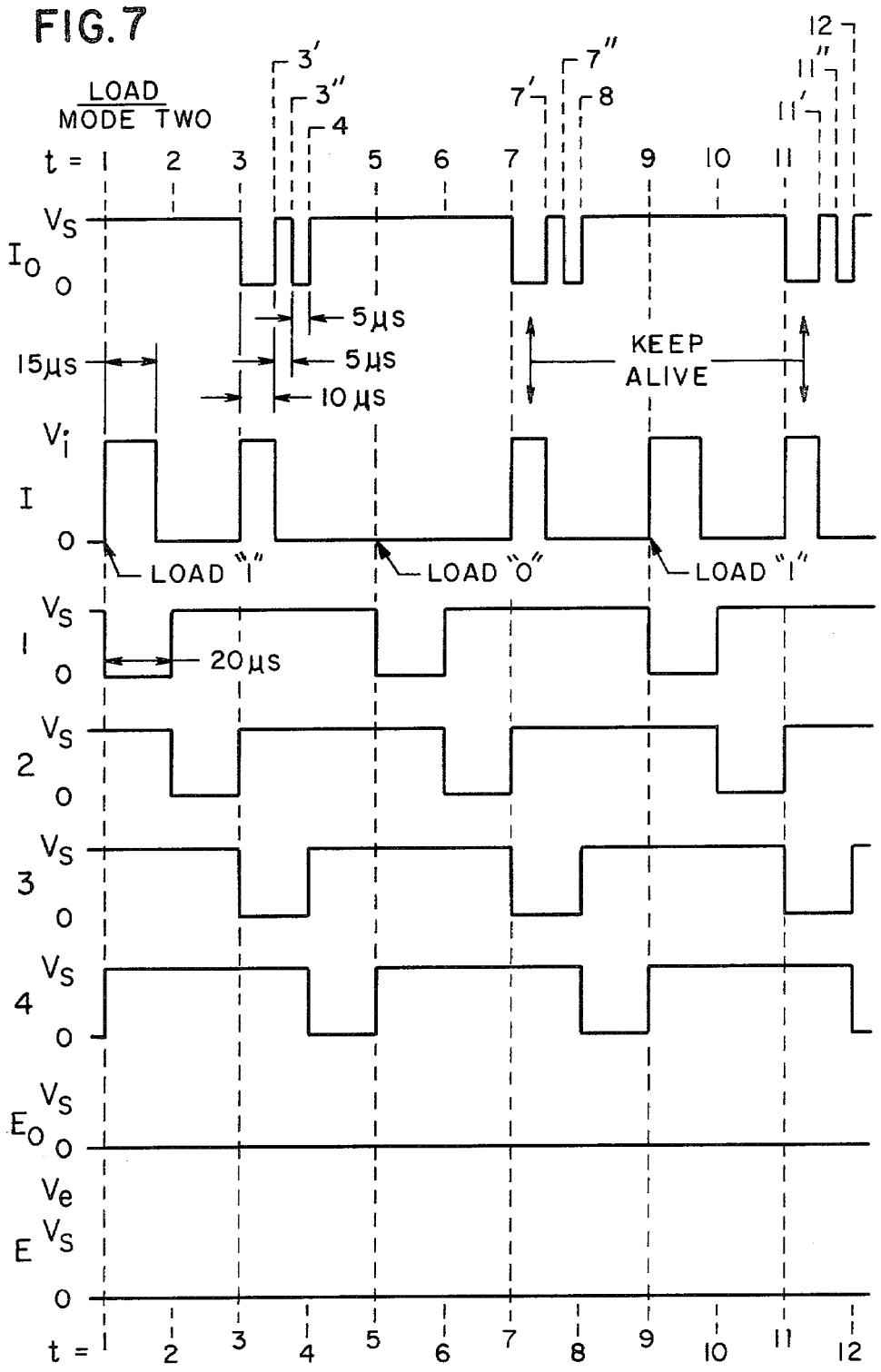
Figure 12A:
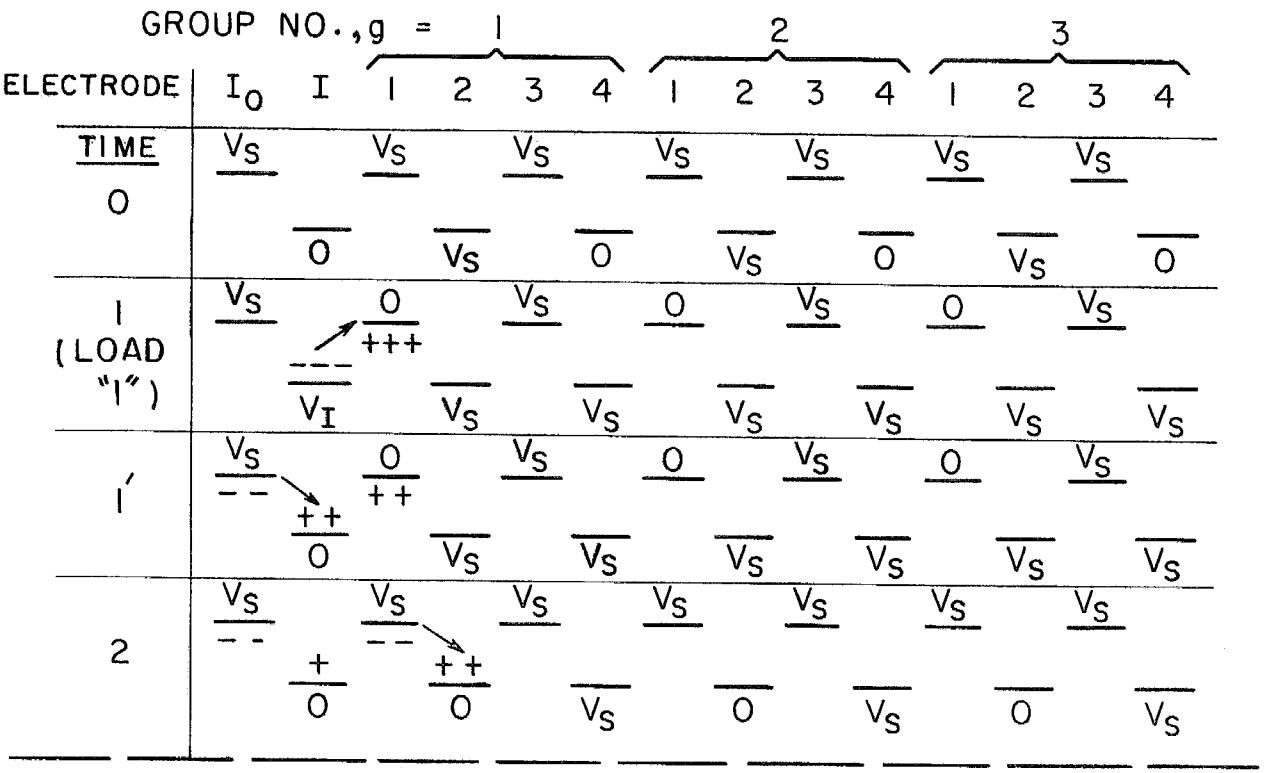
Figure 12E:
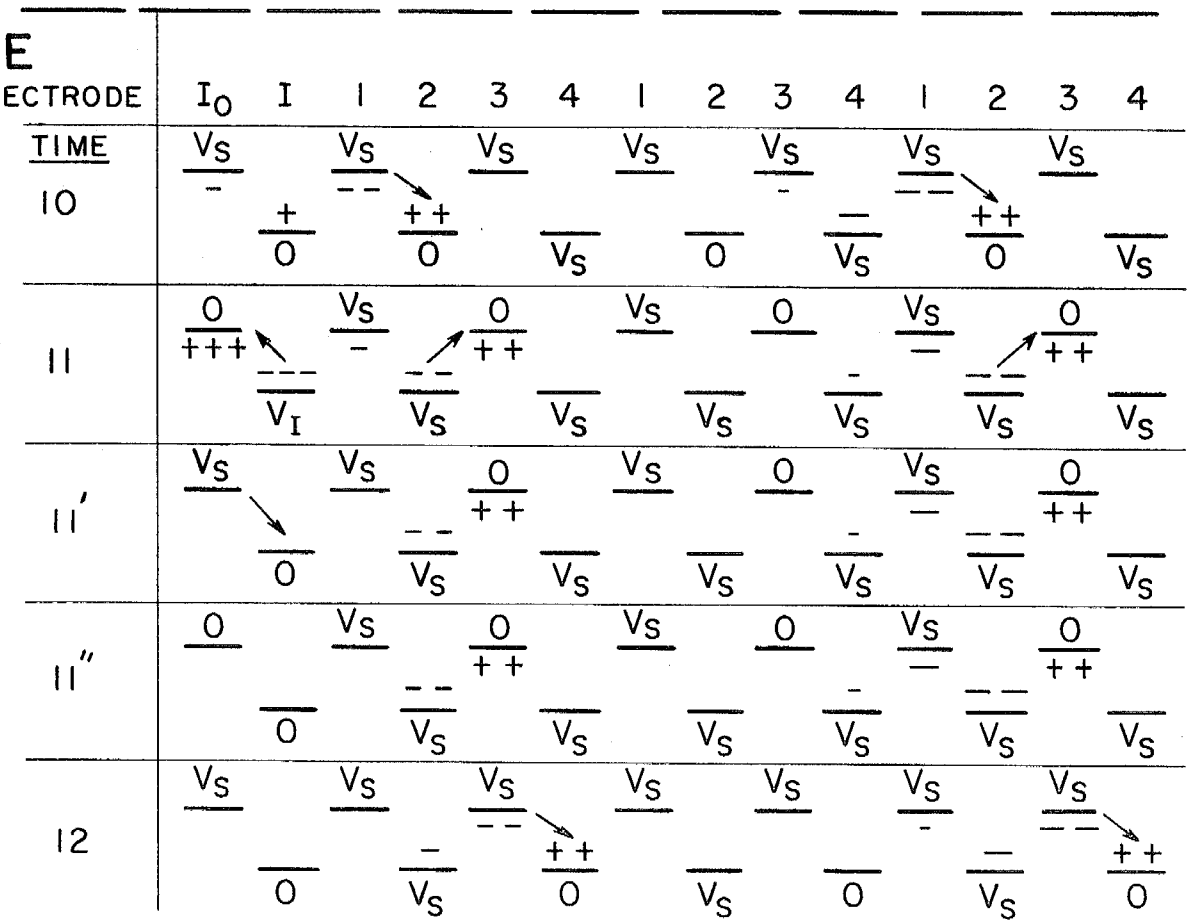

Referring now to FIGS. 7 and 12, an alternative loading sequence, load mode II, is shown during the consecutive loading of 1,0,1. The wave forms, discharges, and resulting wall charges are identical to those shown in FIGS. 5 and 8 for mode I, except for the use of the discharge-quenching polarity removal at load t=3", 7", 11", etc., which is identical to that described for the erase mode II operation.

Consider now the use of a seven channel, five bit display panel 40, FIG. 4, to load an alphanumeric character, arbitrarily chosen to be the numeral 3. FIG. 15 illustrates the load (mode I) and transfer electrode pulses which are applied to the first five groups of a seven channel display panel 40 for forming the numeral 3, which is illustrated in FIG. 14. The control mechanisms continually operate the input drivers for the channels 1 through 7 so the input-keep alive electrodes are pulsed every four clock times to provide the keep-alive pulses, as described previously. As shown in FIG. 15, the same sequence of keep-alive pulses is applied to each input electrode $I_0$ and I in every channel.

To initiate input of the numeral 3, at the initial load clock time t=1 the input drivers 43 for channels 1–7 increase the potential of the input electrodes I for the seven channels from 0 v. to $V_I$ v. The drivers 48 for the transfer electrodes 1 drive the potential for these electrodes from $V_s$ to ground. These "load 1" pulses are the relatively narrow 15 microsecond pulses illustrated at times t=1, 5, 9, 13, and 17 in FIG. 15. The potential difference applied across the input electrodes I and the transfer electrodes $1_1$ provides discharge of all seven cells I-$1_1$ and places a positive charge on the dielectric wall of the first transfer electrode $1_1$ of each channel.

As shown in FIG. 10, the 2, 3, and 4 transfer electrode sets are then pulsed in sequence at load t=2, 3, 4 to move the charges on electrodes $1_1$ to the electrodes $4_1$ of each channel.

Next, at load t=5, $V_i$ input signals are again applied to channels 1, 4 and 7. This results in discharge and the development of new positive charges at the transfer electrodes $1_1$ of channels 1, 4 and 7. In addition, the potential difference developed between the transfer electrode $4_1$ and the transfer electrode $1_2$ shifts the initial positive charges to a position the transfer electrodes $1_2$ of the seven channels. When the 2, 3, 4 transfer electrodes are then pulsed as illustrated, the positive charges are shifted to the transfer electrodes $4_1$ (channels 1, 4 and 7) and the transfer electrodes $4_2$ (all channels).

At load time t=9, third $V_i$ input pulses are applied to the channels 1, 4 and 7 along with the 1234 transfer electrode pulsing. At load time t=13, fourth input pulses are applied to channels 1, 4, and 7, again with the 1234 pulsing. The final steps in producing the numeral 3 are initiated at load t=17 and involve $V_i$ pulsing of the input electrodes I for channels 1 and 7 and the 1234 transfer electrode pulsing. The result is the formation of the numeral 3 by the combination of the individual lighted cells, as shown in FIG. 14.

The position of the numeral 3 can be moved along the channels by continuing the 1234 transfer electrode pulsing. The numeral also can be held, can be shifted simultaneously with other information loading, and, ultimately, can be shifted to the erase electrodes and erased. All these modes are accomplished precisely as discussed previously. Of course, as long as additional input signals are not applied, only the numeral 3 will appear.

It should be emphasized that the times and time intervals given throughout are by way of example only, for those skilled in the art will readily adapt these and other parameters to their particular plasma apparatus and function to achieve optimum operation.

Having thus described a preferred construction and preferred modes of operation for the capacitive-coupled input-keep alive and capacitive-coupled erase cell, what is claimed is:

1. In a plasma charge transfer device of the type having (a) a channel containing an ionizable medium, (b) transfer electrodes positioned on the inside wall surfaces, said transfer electrodes being covered by a dielectric medium and arranged in alternating sequence on opposite inside wall surfaces, and (c) means for applying a potential difference between adjacent opposite transfer electrodes so that the medium will ionize proximate said adjacent transfer electrodes and leave a charge proximate one of said adjacent transfer electrodes, the application of succeeding potential differences between opposite adjacent transfer electrodes along the length of the channel operating to successively discharge the medium and thereby shift said charge away from an input position of the channel toward an output position, the improvement comprising (d) a pair of electrodes, covered by a dielectric medium interposed between each electrode of the pair and the ionizable medium, and located on opposite inner wall surfaces adjacent the input position of the channel, the pair of electrodes forming a keep-alive cell and one of the pair cooperating with a transfer electrode at the input position for initiating ionization of the medium to initiate charge transfer along the channel.

2. The device of claim 1 wherein the device is a shift register memory.

3. The device of claim 1 wherein the device is a display panel.

4. The device of claim 1, 2 or 3, further comprising (e) a second pair of electrodes, each electrode of the second pair being covered by a dielectric medium interposed between the electrode and the ionizable medium, and located on opposite inner wall surfaces and cooperating with a transfer electrode at the output position of the channel, for terminating the successive ionization of the medium and charge transfer along the channel.

5. A method of entering information into a plasma gas charge transfer device via a pair of electrodes adjacent an array of charge transfer electrodes, each of the electrodes and the charge transfer electrodes being covered by dielectric material and thereby isolated from the gas, comprising selectively applying voltages across a first cell having walls defined by the dielectric material covering one of the pair of electrodes and an adjacent one of the transfer electrodes to discharge gas within the first cell, and repetitively applying voltages across a second cell having walls defined by the dielectric material covering the pair of electrodes to ionize the gas proximate the second cell and thereby facilitate discharge within the first cell.

6. A method of entering information into and erasing information in a plasma gas transfer device having a first pair of electrodes for entering information in the form of charges into an adjacent array of charge transfer electrodes and a second pair of electrodes adjacent the array for removing charge information from the device, each of the first and second pairs and the charge transfer electrodes being covered by dielectric material and thereby isolated from the gas, comprising:

selectively applying voltages across a first cell having walls defined by the dielectric material covering one of the first pair of electrodes and an adjacent one of the array of charge transfer electrodes to discharge gas within the first cell and thereby selectively input charge to the array;

repetitively applying voltages across a second cell having walls defined by the dielectric material covering the first pair of electrodes to ionize the gas proximate the second cell and thereby facilitate discharge within the first cell;

selectively applying synchronous voltages to the array of charge transfer electrodes to transfer the charge along the array; and selectively applying voltages across a third cell having walls defined by the dielectric material covering the second pair of electrodes for receiving the charge from the array and, by selective ionization of the medium based upon the applied voltage and the charge state, terminating charge transfer.

7. The method of claim 5 or 6, further comprising terminating the voltage applied across the second cell after a predetermined time at which the walls of the second cell are essentially charge-neutral.

8. The method of claim 6 further comprising terminating the voltage applied across the third cell after a predetermined time at which the walls of the third cell are essentially charge-neutral.

9. A method of operating a plasma charge transfer device of the type having a channel containing an ionizable medium, said channel being defined within a walled structure by transfer electrodes positioned on the inside wall surfaces, said transfer electrodes being arranged in alternating sequence on opposite inside wall surfaces; the application of a suitable potential difference between a pair of first and second adjacent opposite transfer electrodes in the presence of charge of predetermined polarity on said first of said pair causing the medium to ionize proximate said pair and shift said charge to the second of said pair, the application of potential differences to successive overlapping pairs of said transfer electrodes along the length of the device operating to shift said charge along said successive pairs; the improvement comprising:

(1) applying input pulses to a first one of a pair of input-keep alive electrodes located adjacent said first transfer electrode, said input pulses being synchronized with the potential differences applied to shift said charge along said transfer electrodes for discharging the ionizable medium proximate said first input-keep alive electrode and said first transfer electrode and thereby apply said charge to said first transfer electrode; and (2) applying to said pair of input-keep alive electrodes keep-alive pulses which are multiplexed with the input pulses.

* * * * *

UNITED STATES PATENT AND TRADEMARK OFFICE

CERTIFICATE OF CORRECTION

PATENT NO. : 4,233,544

DATED : November 11, 1980

INVENTOR(S) : William E. Coleman

It is certified that error appears in the above-identified patent and that said Letters Patent are hereby corrected as shown below:

Column 11, Claim 1, line 47, after "medium," insert --said channel being defined within a walled structure,--.

Signed and Sealed this

*Tenth* Day of *February 1981*

[SEAL]

*Attest:*

RENE D. TEGTMEYER

*Attesting Officer*

*Acting Commissioner of Patents and Trademarks*